US010259692B2

(12) United States Patent
Vestre

(10) Patent No.: US 10,259,692 B2
(45) Date of Patent: Apr. 16, 2019

(54) HYBRID CRANE

(71) Applicant: SEAONICAS AS, Ålesund (NO)

(72) Inventor: Johan Vestre, Ålesund (NO)

( * ) Notice: Subject to any disclaimer, the term of this patent is extended or adjusted under 35 U.S.C. 154(b) by 528 days.

(21) Appl. No.: 14/405,829

(22) PCT Filed: Jun. 6, 2013

(86) PCT No.: PCT/NO2013/050101
§ 371 (c)(1),
(2) Date: Dec. 5, 2014

(87) PCT Pub. No.: WO2014/200354
PCT Pub. Date: Dec. 18, 2014

(65) Prior Publication Data

US 2016/0152451 A1 Jun. 2, 2016

Related U.S. Application Data

(60) Provisional application No. 61/656,098, filed on Jun. 6, 2012.

(51) Int. Cl.
*B66C 23/52* (2006.01)
*B66C 23/68* (2006.01)
(Continued)

(52) U.S. Cl.
CPC ..... *B66C 23/52* (2013.01); *B63B 27/10* (2013.01); *B63B 27/30* (2013.01); *B66C 13/54* (2013.01);
(Continued)

(58) Field of Classification Search
CPC ..... B66C 23/00; B66C 23/06; B66C 23/16; B66C 23/163; B66C 23/166; B66C 23/26;
(Continued)

(56) References Cited

U.S. PATENT DOCUMENTS 3,117,686 A 1/1964 Brown
3,279,632 A 10/1966 Kramlich
(Continued)

FOREIGN PATENT DOCUMENTS

DE 20005890 U1 8/2000
EP 1138627 A2 10/2001
(Continued)

OTHER PUBLICATIONS

European Search Report Application No. 16199995.
(Continued)

*Primary Examiner* — Michael R Mansen
*Assistant Examiner* — Juan J Campos, Jr.
(74) *Attorney, Agent, or Firm* — Advitam IP LLC

(57) ABSTRACT

A knuckle boom crane at least comprising: a pedestal; a tower 2 arranged on top of the pedestal; an operator cabin 4 fixed to the tower 2; a machine house 3; a winch 5 with a wire 6 positioned at an upper end of the tower 2 so that the upper rim of the reel of the winch 5 protrudes above the top of the tower 2; or an alternative wire routing with a winch with a wire arranged external to the crane where the wire is fed to a first sheave arranged at an upper end of the tower 2 so that the upper rim of the sheave protrudes above the top of the tower 2; a main boom 14 which is at its first end is pivotally connected to the tower 2 at its second end the main boom 14 is pivotally connected with a first end of a knuckle boom 12, the second end of the knuckle boom is provided with at least one second sheave 10, where the main boom 14 is provided with an aperture 7 proximate to its first end.

8 Claims, 6 Drawing Sheets

(51) Int. Cl.

| | |
|---|---|
| ***B66C 13/54*** | (2006.01) |
| ***B66C 23/00*** | (2006.01) |
| ***B66C 23/16*** | (2006.01) |
| ***B66C 23/53*** | (2006.01) |
| ***B66D 1/08*** | (2006.01) |
| ***B66D 1/12*** | (2006.01) |
| ***B63B 27/10*** | (2006.01) |
| ***B63B 27/30*** | (2006.01) |
| ***B66D 1/52*** | (2006.01) |

(52) U.S. Cl.
CPC ..... *B66C 23/163* (2013.01); *B66C 23/53* (2013.01); *B66C 23/54* (2013.01); *B66C 23/68* (2013.01); *B66D 1/08* (2013.01); *B66D 1/12* (2013.01); *B66D 1/525* (2013.01)

(58) Field of Classification Search
CPC ..... B66C 23/36; B66C 23/42; B66C 23/52; B66C 23/525; B66C 23/60; B66C 23/62; B66C 23/64; B66C 23/68; B63B 27/10
See application file for complete search history.

(56) References Cited

U.S. PATENT DOCUMENTS

| | | | | |
|---|---|---|---|---|
| 4,132,387 | A | 1/1979 | Somerville | |
| 5,984,036 | A * | 11/1999 | Higuchi | B62D 33/0604 180/89.12 |
| 8,113,363 | B2 | 2/2012 | Wimmer | |
| 2011/0031205 | A1* | 2/2011 | Roodenburg | B66C 13/06 212/309 |
| 2012/0241404 | A1* | 9/2012 | Bobeck | B66C 23/68 212/300 |

FOREIGN PATENT DOCUMENTS

| | | | |
|---|---|---|---|
| EP | 1477450 | A1 | 11/2004 |
| JP | S58106024 | A | 6/1983 |
| KR | 101027583 | B1 | 4/2011 |
| KR | 101115367 | B1 | 2/2012 |
| WO | 2006/008052 | A1 | 1/2006 |
| WO | 2009/036456 | A2 | 3/2009 |
| WO | 2009/036456 | A3 | 3/2009 |
| WO | 2010/093251 | A1 | 8/2010 |
| WO | 2012/039623 | A1 | 3/2012 |

OTHER PUBLICATIONS

European Search Report Application No. 16200012.
International Search Report PCTEP2005007629.
International Search Report PCTNO2011000261.
International Search Report PCTUS2008076450.
English Translation of the Abstract of KR101027583B1.
English Translation of the Abstract of KR101115367B1.

* cited by examiner

| Pos | Description |
|---|---|
| 8 | Load control valve |
| 7 | Control system |
| 6 | Electrical motor |
| 5 | Frequency converter |
| 4 | Hydraulic power unit |
| 3 | Directional valve |
| 2 | Hydraulic motor |
| 1 | Winch |

HYBRID CRANE

TECHNICAL FIELD

This invention relates to cranes and particularly to cranes located on the deck of a vessel. In particular the present invention relates to knuckle boom cranes and elements thereof.

BACKGROUND ART

There are numerous types of cranes for on-ship/deck operation such as rotary jib cranes with or without telescopic boom, rotary boom cranes and knuckle boom cranes.

The present invention discloses a knuckle boom crane. Traditional knuckle boom cranes consist of a pedestal for interface with the deck, slewing bearings which provides rotation to a tower, the tower is engaged with a first main boom which is pivotally hinged to the tower, whilst the other end of the main boom is pivotally connected to the knuckle boom (FIG. 1). At its extreme other end the knuckle boom is provided with one or more sheaves. Adjacent to the top of the tower and the pivot hinge of the main boom a winch is provided and optionally an operators cabin. Wire is fed from the winch via several sheaves to the sheave arranged at the extreme end of the knuckle boom and at its end the wire will typically be provided with a hook. Rotation of the winch will feed or hoist the hook at the end of the wire. The knuckle boom may be of a fixed type or a telescopic type.

The knuckle boom design is well suited for use on ship as it provides good control of the payload as the main boom and the knuckle boom as well as the wire can be operated simultaneously. This means that the booms can be lowered so as to reduce the pendulum length of the hook and thereby reduce pendulum movements of the payload.

Knuckle boom cranes suffers from some drawbacks the wire will have to travel over a numbers of sheaves which makes threading of the wire difficult, it means that there are several service points on the top of the booms which are not easily accessed as shown in a crane of the prior art in FIG. 1.

Knuckle boom cranes are usually hydraulic driven cranes, and the interface between the ship and the crane includes several hydraulic high pressure hoses in addition to this if the crane includes an operators cabin the interface will include electric power for feeding the control system in the operators' cabin.

It shall also be mentioned that heave compensation is important for on-ship operation, and that knuckle boom cranes are particularly suited for heave compensation.

It is an object according to the present invention to provide a knuckle boom crane that does not suffer from the disadvantages above, where the crane shall be adapted for applications such as:

a. Lifts from internal deck to seabed (Subsea lift)
b. Lifts between vessel and quay side in sheltered waters (Harbour lift)
c. Lifts on vessels deck (internal lift)
d. Ship to ship

DISCLOSURE OF INVENTION

According to the present invention it is provided a system and elements that does not suffer from the drawbacks indicated above. It is disclosed an offshore crane, ready to be installed on a vessel.

Special attention has been given to ease access for service and maintenance. The crane is of knuckle boom design which gives the operator the opportunity to place the load very precisely down in nearly any position within the area of the cranes working radius. The load can be transferred either by operating the winch or the booms or a combination of both.

The crane structural system consists of pedestal, tower, machine house, operator's cabin and booms were the tower is the rotating part of the crane mounted on a slewing bearing on top of the pedestal.

The main winch is equipped with active heave compensation and it has all required functionality for safe and efficient lifting operations.

Normal operation of the crane is performed from an operator chair located in the crane cabin. Emergency operation is performed through an emergency panel or by use of valve levers located in the crane. The crane has one hydraulic power unit supplying all the consumers with oil. Electric power is fed from the vessel.

According to one embodiment the knuckle boom crane at least comprises:

a) a pedestal;
b) a tower arranged on top of the pedestal;
c) a winch with a wire positioned at an upper end of the tower so that the upper rim of the reel of the winch protrudes above the top of the tower; or a wire routing with a winch with a wire arranged external to the crane where the wire is fed to a first sheave arranged at an upper end of the tower so that the upper rim of the sheave protrudes above the top of the tower;
d) a main boom which is at its first end is pivotally connected to the tower at its second end the main boom is pivotally connected with a first end of a knuckle boom, the second end of the knuckle boom is provided with at least one second sheave, where the main boom is provided with an aperture proximate to its first end where the wire is routed through the aperture and directly to the at least one sheave.

The knuckle boom crane may also comprise an operator cabin fixed to the tower, and/or a machine house.

The tower of the knuckle boom crane can be engaged with the pedestal via a slew bearing. In one embodiment the operator cabin is mounted on vibration dampers on a cabin platform.

The knuckle boom crane may according to one embodiment be provided with an electro operated winch, with at least one electric motor and at least one hydraulic motor. The winch can be rotatably arranged between two support plates which extend out from an upper side of the tower opposite of the main boom.

The main boom can be boomerang shaped and where the concave side of the boom faces downward. Vertical movements of the main boom and the knuckle boom is provided by at least two cylinders, where the at least two cylinders are one of: hydraulic cylinder, electro hydraulic cylinder or electric cylinder.

The wire from the winch can be routed through the aperture and directly to the at least one sheave.

According to one aspect of the invention it is provided a main boom adapted for operation with a knuckle boom crane, where the main boom is concave-convex and is provided with an aperture proximate to one end of the main boom, where the aperture is extended with its opening stretching from the convex side of the boom to the concave side of the boom.

The main boom can be provided with means for pivotally engagement with a knuckle boom at one end and with a crane tower at the other end. Moreover the main boom can be provided with means for engagement with at least one cylinder. Further the main boom can be provided with two means for engagement with two cylinders, where the means are adapted for pivotal engagement.

A according to an aspect of the invention it is provided a wire winch adapted for operation with a knuckle boom crane, where the winch at least comprises:

a) at least one electric motor and at least one hydraulic motor for operation of the winch;
b) a control system;
c) a frequency converter for speed and directional adjustment of the at least one electric motor and;
d) a hydraulic power unit in operational engagement with a directional valve, where the directional valve controls the rotary direction of the winch.

The control system can be configured to provide automatic heave compensation signals to the frequency controller and the hydraulic power unit so as to provide for an active heave compensated winch.

Other features will be apparent from the appending claims.

BRIEF DESCRIPTION OF DRAWINGS

In order to make the invention more readily understandable, the discussion that follows will refer to the accompanying drawings, in which.

BEST MODE FOR CARRYING OUT THE INVENTION

Figure 1:
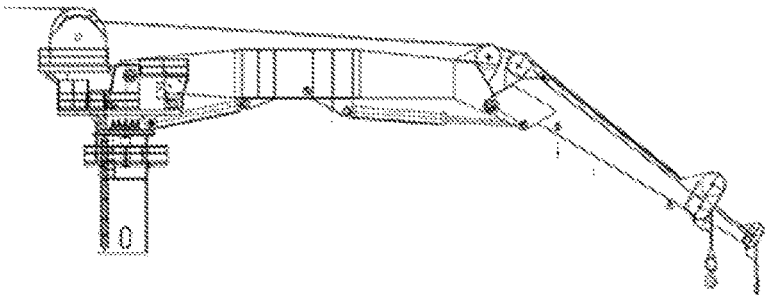
FIG. 1 shows a prior art knuckle boom crane.
Figure 2:
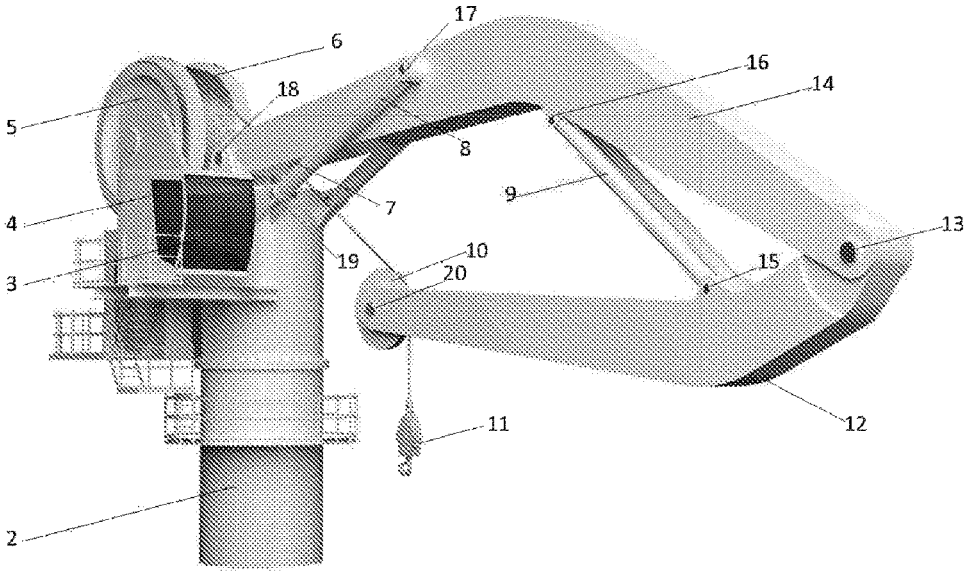
FIG. 2 shows a knuckle boom crane according to one embodiment of the invention.
Figure 3:
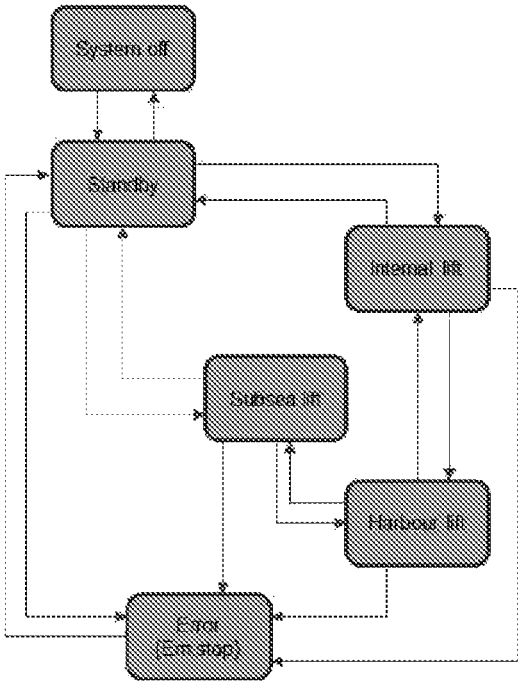
FIG. 3 shows examples of modes of operation that can be selected by an operator according to one embodiment of the present invention.
Figure 4:
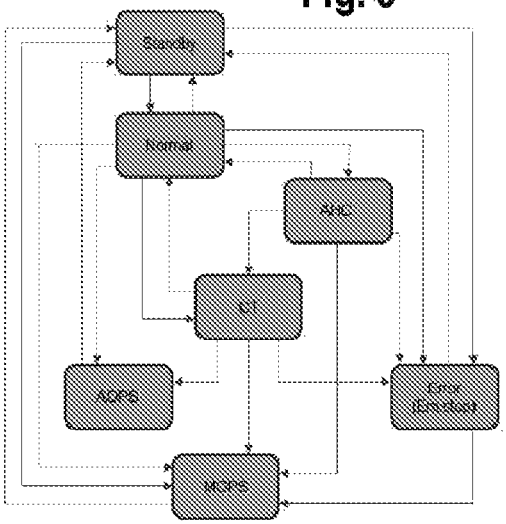
FIG. 4 shows examples of modes for the main winch 5 according to one embodiment of the invention.
Figure 5:
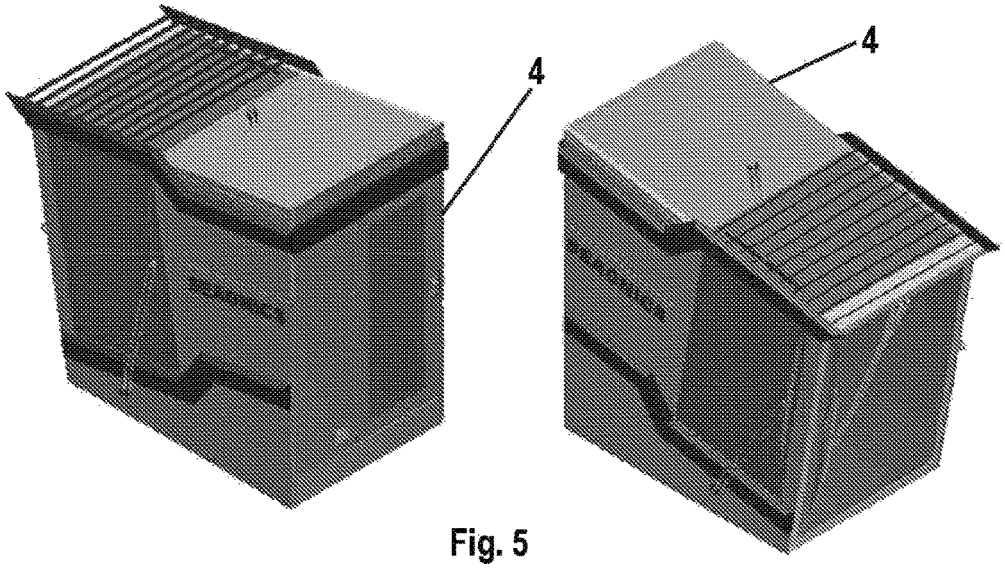
FIG. 5 shows an operator cabin according to one embodiment of the present invention.
Figure 6:
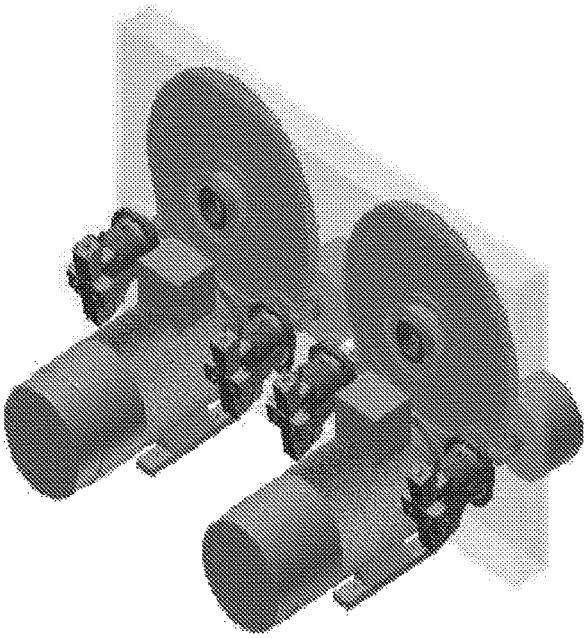
FIG. 6 shows an example of a hybrid drive for the main winch according to one embodiment of the present invention.
Figure 7:
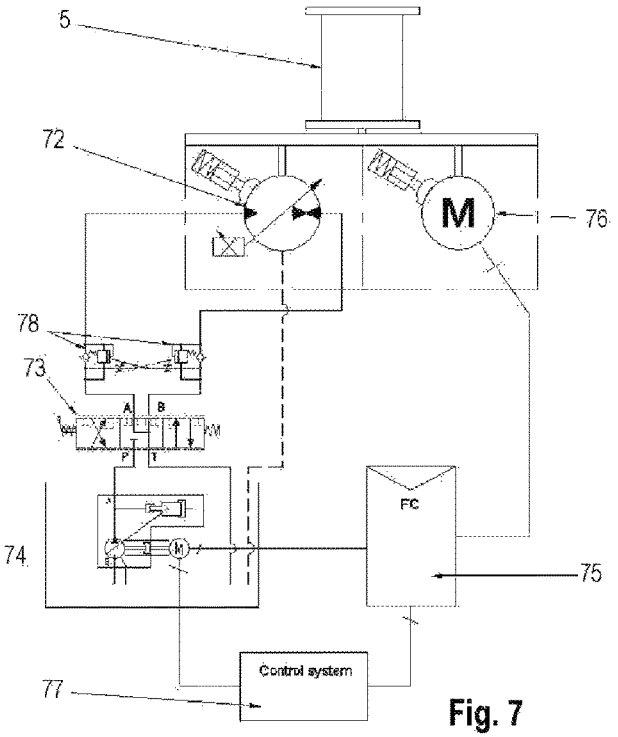
FIG. 7 shows a circuit diagram for a hybrid drive of the main winch according to one embodiment of the present invention.
Figure 8:
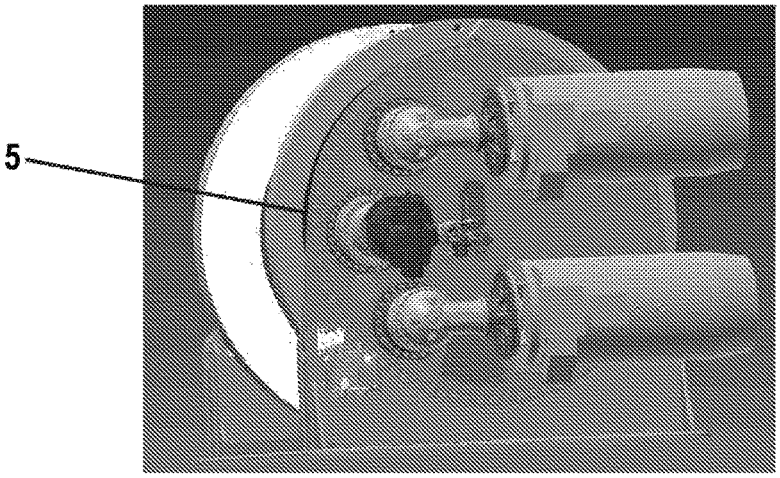
FIG. 8 shows a winch according to one embodiment of the present invention.
Figure 9:
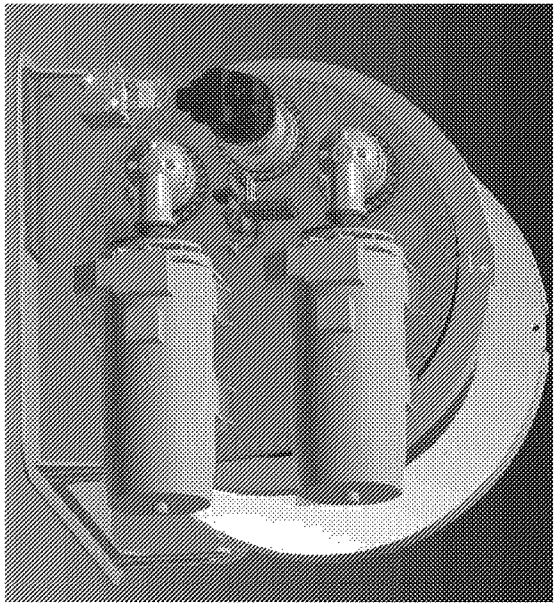
FIG. 9 shows a winch according to the embodiment in FIG. 8 seen from another angle.
Figure 10:
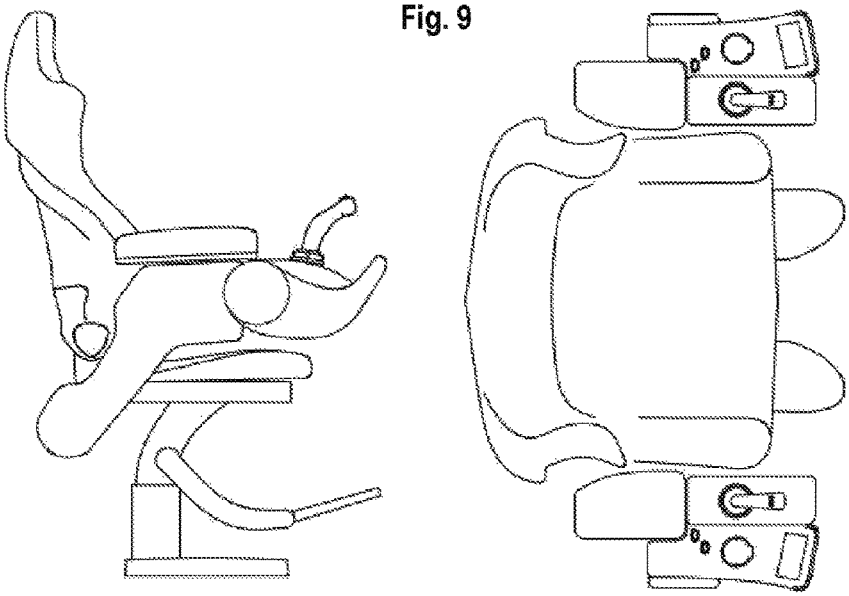
FIG. 10 shows an example of an operator chair with means for operation of the knuckle boom crane according to the present invention.
Figure 11:
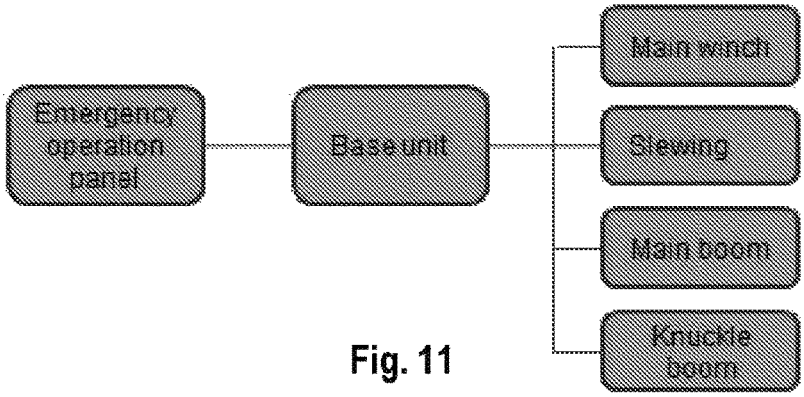
FIG. 11 shows emergency operations.
Figure 12:
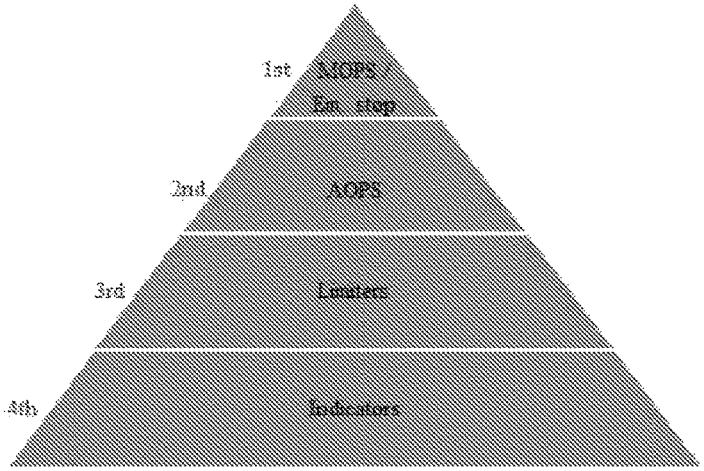
FIG. 12 shows the ranking of the safety system according to one exemplary embodiment of the present invention.

The present invention relates to knuckle boom deck cranes and elements of knuckle boom cranes. In the following discussion it will be adhered to the accompanying drawings; however the drawings are not necessarily to scale nor are all features shown in the drawings mandatory, also some of the features may be excluded. The drawings are meant to ease understanding of the present invention.

In the following discussion the following word may be used interchangeably; sheaves and pulleys, operators house, operators cabin, crane cabin, crane house; boom cylinders and hydraulic cylinders.

The knuckle boom crane according to the present invention is of a rotary type, with slewing bearing between the pedestal and the tower 2.

The crane system basically consists of the following main components:

Crane Structure

Provides foundation and routing for winches 5 and serves as the interface towards the ship. It consists of a pedestal, slewing bearing, tower 2, booms 12, 14 and operator's cabin 4.

Main Winch

Lift and lower payloads.

Hydraulic Power Unit (HPU)

Provide hydraulic power to consumers fitted on the crane.

Accumulator Unit

Storing and releasing energy in combination with the hydraulic power unit.

Operator Cabin

Station for normal operation of the crane.

Main Boom—"Boomerang" Shape

The knuckle boom crane consists of a crane house/tower 2 which is bolted via a slew bearing to a pedestal. The pedestal is the interface to the deck of a ship. The knuckle boom crane according to the present invention can be of a free standing type, that is the interface between the pedestal and the deck consists of fixing means such as bolts for fixing the pedestal to the deck, moreover there is an electric interface between the pedestal and the ship. The ship delivers electric power supply to the crane. According to one embodiment of the invention the operation of the crane is electro hydraulic (hybrid system) and the hydraulic system is independent of any external to the crane hydraulic system i.e. being a self contained system. This provides for a neat and simple interface between the crane and the deck to which the crane is mounted. At least one electric pump builds up the pressure for the hydraulic system; the hydraulic system also includes a reservoir for the hydraulic fluid.

The idea of an electro hydraulic system is that the "heavy work" is carried out by the hydraulics whilst acceleration and fine movements are controlled and carried out by electric motors/actuators. Further description of the electro hydraulic system, the hydraulic system, the electric system and control thereof is described below.

The tower 2 is in accordance with one embodiment of the invention a tubular shaped member which is at its lower end arranged vertically on the pedestal. At its upper end an operator cabin 4 is fixed to the tower 2. A machine house 3 is arranged adjacent to the operator cabin 4. According to a first embodiment of the invention a winch 5 is rotatably arranged between two support plates 22 which extend out from an upper side of the tower 2 opposite of a main boom 14. The winch 5 is of an electro hydraulic type, thus heave compensation and movements with high acceleration are carried out by the electric motor internal of the winch whereas the movements with low acceleration are controlled by hydraulic motors.

In a second embodiment the winch is arranged external to the crane and a sheave is arranged where the winch 5 is arranged in the first embodiment of the invention described above.

The main boom 14 is at a first end pivotally connected to two support plates 21 with eyes for an axle 18. At its second end the main boom 14 is pivotally connected with a first end of a knuckle boom/arm 12. The second end of the knuckle boom is provided with at least one sheave 10. The sheave is configured to rotate around an axis 20. The main boom 14 is concave-convex shaped and the concave side of the boom 14 is facing downward with respect to a horizontal plane while the convex side of the crane is the opposite side of the boom 14. Proximate to its first end the boom 14 is provided with an aperture 7. The concave-convex shape together with the aperture 7 makes it possible to design the knuckle boom crane with only one sheave 10 which really facilitates threading of the wire 6. The wire is fed from the winch 5 or in the second alternative embodiment from a winch via a sheave arranged where the winch of the first embodiment is arranged through the aperture 7 and directly to the at least one sheave 10.

Both booms 12, 14 are controlled with hydraulic cylinders 8, 9. This way, movements of payload can be limited as the boom tip; the second end of the knuckle boom 12 can be kept at a limited height above deck. This feature makes the crane safe and efficient.

Routing of wire directly from winch to sheave in knuckle boom.

Advantages of the concave-convex knuckle boom design are among others:

a. Routing of wire directly from winch 5 to the at least one sheave 10 in knuckle boom or in the alternative embodiment directly from a first sheave arranged adjacent to the top of the tower 2 to the at least one sheave 10.
   - Total weight of crane is reduced.
   - Reduced number of sheaves.
     - Less wear on wire/fiber rope during automatic heave compensation.
   - Number of required service points are reduced, due to the reduced number of moving parts.
   - Easier rerouting of wire through the crane with i.e. an external fiber rope handling system.
   - Beneficial boom tip placement variations.
     - Min radius reduced compared to "standard" knuckle boom cranes.
     - More height is available without reducing the benefits of a standard knuckle boom crane.

Control System Overview

The crane control system is based on an Industrial Controller (IC), control cabinets and sensors. The IC reads physical parameters such as boom angles, wire length on winch and crane load. The parameters are provided by sensors.

General

Crane functions are controlled by joysticks, switches and an operator panel inside the cabin 4. The joysticks control the winch 5, slew and booms 12, 14. The response on joystick movement can be tuned. Interfaces between operator controls, sensors and actuators are based upon a distributed I/O system communicating via Bus.

All sensor signals are routed to the industrial controller. Based on these signals the IC controls the crane, evaluates safety measures, activates alarms and presents necessary information on an operator display in the cabin 4.

The actual working radius and allowable safe working load (SWL) are calculated in the control system, these values are presented in the operator display. The operator is naturally responsible for safe operation of the crane, but the calculated values are also used as a safety measure to reduce the boom speeds in the end-positions for the boom cylinders 8, 9.

The load measurement is performed by a load cell bolt, mounted in the wire sheave 10 at the second end of the knuckle boom. The load cell amplifier gives an analogue input signal to the IC.

On the HPU several sensors/transmitters are installed, feedback on temperature, pressure from each pump and filter indication is available for the operator at all times. For instance are high oil temperature alarms and start/stop of oil coolers controlled by the IC-based on the input from the temperature transmitter on the HPU.

Encoders control the hook stop function of the winches 5. The encoder signals are input to the IC, which counts pulses from the sensors and also detect the direction of the motion. Via the operator display it is possible to reset the counting to zero and set span for the motion. The display will continuously show the actual wire paid out on the winch (from hook stop upper position).

The Motion Reference Unit, MRU, measures the vessels movements (roll, pitch, heave and heave acceleration). Based on the MRU signals and the crane position related to the vessel, the IC calculates the actual movement of the boom tip/second end of knuckle boom 12. During active heave compensation the MRU generates a reference/feedback signal to the control system in order to compensate for the boom tip movement.

Modes of Operation

Depending on the task to be performed, the operator can select the required system mode. Please note that the control system, under certain conditions, automatically will select one of the below modes.

Modes and Transitions

The main winch 5 can change between the modes shown in the figure below. Arrows indicate possible transitions.

TABLE 1

| | |
|---|---|
| Standby | This is the default mode for the winch 5 when the control system is ON |
| Normal | In this mode the winch 5 is run from the joystick, the brakes are engaged during deck lift and disengaged during subsea lift. |
| AHC | This mode is used to compensate the ship movement caused by waves. AHC operation mode will keep the distance between the seabed and load constant. The AHC controller gets its set point from a MRU. The joystick may be used to both hoist and lower the payload while in AHC, but the sum of speed signals will never exceed the winch capacity. |
| CT | In this mode the unit gets its speed set point from a Constant Tension controller detecting rope tension variations, thereby keeping the rope tension near constant. The set point may be changed by the operator at any time. Detection of rope tension is carried out by a sensor. |
| AOPS | Automatic overload protection system (see safety functions for details) |
| MOPS | Manual overload protection system (see safety functions for details) |
| Error | Fault in the system, as example drive unit error, software communication failure or load drop. |

Crane Controls and Instrumentation

TABLE 2

| | | |
|---|---|---|
| Normal crane operation (joysticks on operators chair) | Functions | Slewing<br>Main boom 14<br>Knuckle boom 12<br>Main winch 5 |
| Armrest/operator panel | Instrumentation/activators | Emergency stop<br>System on/off<br>Joystick on/off<br>MOPS main winch |
| Emergency operation (emergency panel) | Functions | Slewing<br>Main boom |

TABLE 2-continued

| | |
|---|---|
| | Knuckle boom<br>Main winch |

Operators' Cabin

The operator's cabin 4 is mounted on vibration dampers on the cabin platform. The cabin is fitted with sufficient windows to give the operator an adequate view of the area of operation including hook and hook position.

The windows can be composed of laminated glass. The front window is designed to maximize the area of visibility.

Front and roof window may be provided with wipers and washers. The top window can be supplied with safety bars.

In accordance to one embodiment the cabin 4 may comprise:

Air condition and ventilation
Activators for window wipers.
Fire extinguisher
Internal lightning
Stereo with loudspeakers.
Display for ROV picture
Display for cameras on crane
Prepared for installation of VHF/UHF or installed VHF/UHF Operators' Chair The operational chair is according to one embodiment equipped with a joystick on each armrest, in addition there can be display with graphical user interface were system components can be selected. Each main component can be provided with its own page on the GUI were required information is available. Obviously other design with joysticks arranged on a pad with a gooseneck which facilitates movement of the pad is an alternative design. The GUI is microprocessor controlled hence the GUI scales well and it might be upgraded and reprogrammed. In one embodiment the armrest controls on the operators chair are:

Right Joystick
Main winch (Y-axis)
Elbow boom (X-axis)
Speaker (push button).
Left Joystick
Main boom (Y-axis)
Slewing (X-axis)
Horn (push button).

All joysticks may have two axes with spring return to zero. The operational speed is proportional to the handle movement but it is limited by the control system to give approximately constant power.

Operator Display/Graphical User Interface

The operator display provides interaction between the operator and the control system in order to assure safe operation of the crane in all modes. From the GUI, different systems components can be selected. These system components have a common GUI platform and the alternative window based screen images are of similar design.

Main Features:
Component selection
Mode selection
Type of lift (Internal/Harbour lift, external)
AHC
CT
Ship to ship
Load indication with allowable load/radius information.
Sub component info
Drive unit
Brakes
Hydraulic pressure and temperature
Filter status.

Operator Panel

An operator panel can be located next to the operator's chair. The operator's panel contains buttons and switches for safety measures and operation of auxiliary equipment such as window wipers and washer, stereo and optionally for UHF/VHF.

Main Equipment/Functions:
Emergency stop
Mushroom type push button.
MOPS main winch
Push button w/cover to avoid unintended activation.
Key switch, handling of personnel Off/On
Key switch, system Off/On
Key switch, joystick Off/On Emergency Operation There are two types of emergency operation panels on this crane. One type for operating the crane and winches, the other is emergency start/stop of the pumps on the HPU. The activators for emergency start/stop of HPU are located on the starter cabinets.

The emergency operation panel and its base unit are located in the operator cabin 4. There is one common panel for operation of all the crane functions.

The emergency operation panel is portable and it is equipped with a cable for connection to the base unit. As there is no emergency stop button on the panel, it must be used within immediate reach of one. It is recommended that the emergency operation panel is used while seated in the operator chair.

The handles on the emergency operation panel is "hold to run" type and their function is clearly marked.

Safety Functions and Instrumentation

TABLE 3

| | | |
|---|---|---|
| Main winch | MOPS, Manual overload protection | The system can be activated at all time and at any configuration, including after emergency stop and power failure. When activated the system will maintain a retaining force of approx. 20% of maximum rated capacity. All other functions are overridden during activation. The valves to be activated are powered by UPS. |
| | Fail safe brake | The Fail-Safe brakes are spring applied and hydraulic released, this means that it starts to brake when the oil pressure to the brake disappears. As this system is fitted with handling of personnel the winch has two independent brakes, one on the winch drives and one directly on the drum. |
| | AOPS, Automatic overload protection | The system continuously monitors the loads and load moment on the crane. Load increasing above the set point for activation will make the winch pay out automatically to avoid damage to the crane and its components |
| | Motion limiter | An encoder is fitted to calculate the actual hook position. End stop is programmed in upper position and a bitter end is set (5 turns left with wire on the drum) |
| Crane | Main boom/knuckle boom | Load holding valve and sensors for reduction of speed at end positions. |
| | Slewing | Load holding valve and fail safe brake |
| Hydraulic system | Relief valves | All hydraulic pressure lines are equipped with relief valves to prevent |

TABLE 3-continued

| | | |
|---|---|---|
| | | excessive pressure in the system. |
| Electric system | Overload protection | The system is equipped with circuit breakers and the frequency drive has internal safety measures in case of over current, hot motor, communication error etc. |
| Complete system | Emergency stop | When activated the unit will stop. (Hydraulic and electric energy will be cut off). |

Note:
control system will still be operational.

Ranking of Safety System

In the below figure the order of precedence of the safety measures are shown. In case of conflicting functions the measures at a higher level shall have priority. Emergency stop/MOPS shall have equal priority.

Hydraulic System

The crane can be designed as a self-contained unit without any hydraulic interface to the vessel.

Hydraulic power unit, drives and accumulator system which is dimensioned to allow operation at nominal speed and AHC capacities in accordance with industry standard regulations.

Components

The hydraulic system basically consist of the following components Hydraulic power unit (HPU)

Provides hydraulic energy to the different consumers. It stores, cools and filtrates the hydraulic oil in the system.

Accumulator

The hydraulic accumulator is a storage reservoir in which a non-compressible hydraulic fluid is held under pressure by nitrogen. The main reasons for use of accumulators in the hydraulic system are to reduce the size of the pump without reducing capacity during extremes of demand. It also aids the supply circuit to respond quickly to any temporary demand and to smooth pulsations in the system.

Hydraulic Consumer

Consumer of hydraulic oil such as a winch 5, slewing gear or luffing cylinders.

Hydraulic Manifold

The hydraulic manifold is a component which regulates fluid flow between pumps and actuators and other components in a hydraulic system. It is like a switchboard in an electrical circuit because it lets the operator control how much fluid flows between which components of a hydraulic machinery.

Hydraulic Piping System

This includes pipes

Drive Unit—Hybrid

A combination of hydraulic and electrical motors is according to one embodiment provided for operation of the machinery.

In one example of design the winch 5 is a 150 Te winch for crane:

With at least one electrical motors (approx 500 kW each)

At least one hydraulic motor such as Variable displacement hydraulic motor A6VM 1000 cm3.

The number and combinations off drive units will vary depending on size and requirements for the equipment it is installed on.

The hydraulic motors are mainly for load holding while the electric motors provide speed and acceleration.

Advantages:

Electrical power can be regenerated to the vessel.

Flexible solution with regards to available speed at different loads.

Reduced complexity on hydraulic power unit.

Reduced complexity on hydraulic motors.

Reduced installation time.

Electric System

The electro installation is completed on the crane, ready for termination on the slip ring in the pedestal. The slip ring is a typical electric interface to the ship.

TABLE 4

Power section

| Item no | Description | Voltage (AC) | Power (kW) | Comment |
|---|---|---|---|---|
| 1 | 2 x main pump motors | 690 V/60 Hz | 260 kW | S1-100% |
| 2 | 2 x aux pump motors | 690 V/60 Hz | 18 kW | S1-100% |
| 3 | 1 x filtration unit pump motor | 690 V/60 Hz | 15 kW | S1-100% |
| 4 | 2 x cooler motors (return oil) | 690 V/60 Hz | 10 kW | S1-100% |
| 5 | 1 x cooler motors (gear) | 690 V/60 Hz | 3.5 kW | S1-100% |
| 6 | 1 x ventilation motor | 690 V/60 Hz | 6 kW | S1-100% |
| 7 | 1 x Emergency motor | 690 V/60 Hz | 45 kW | S1-100% |
| 8 | 1 x Ground/PE | | | |
| 9 | Control system supply | 230 V/60 Hz | | (conn. to vessel UPS) |
| 10 | Lights and heating | 230 V/60 Hz | | |
| 11 | Spare | 230 V/60 Hz | | |

TABLE 5

Signal section

| Item no | Description | Voltage (AC) | Silver quality | Comment |
|---|---|---|---|---|
| 1 | Emergency stop | | No | 4 rings |
| 2 | Intercom system | | No | 4 rings |
| 3 | Power to IC cabinet | 24 V DC, 20 A | No | 2 rings |
| 4 | Ethernet (control system) | | No | 5 rings |
| 5 | Can bus (control system) | | No | 2 rings |
| 6 | Fire alarm | | No | 4 rings |
| 7 | PA system | | No | 4 rings |
| 8 | RS-485 radio | | No | 4 rings |
| 9 | Ethernet (Slave monitor sys) | | No | 4 rings |

Lighting

The crane can be equipped with the following lights:

1 flood light below operator cabin (400 W).

2 self-levelling flood lights on booms (400 W).

Lights for main winch camera.

Working lights in machinery room.

Working lights in crane tower.

Emergency Stop

A manually operated emergency stop system, leading to shut-down and stop of the crane movements is fitted. Simultaneously, the brakes are engaged in a progressive and safe manner. The emergency stop maintains its function regardless of any fault in the control system.

Emergency stop actuators are located at convenient locations for immediate use:

One inside crane cabin 4.

One inside tower 2.

One outside of the pedestal (deck level).

One on the HPU starter cabinet door (in machinery house 3)

The arrangement of the emergency stop system is designed so that no single failure will cause loss of duplicated essential or important equipment.

In one embodiment the wire to be used is compact and rotation resistant.

The slewing speed is reduced at high loads.

| | |
|---|---|
| AHC | Active heave compensation |
| HPU | Hydraulic power unit |
| IC | Industrial Controller |
| SWL | safe working load |
| MRU | Motion Reference Unit |
| ROV | Remotely operated vehicle |
| GUI | Graphical user interface |

The invention claimed is:

1. A knuckle two boom crane at least comprising:

a) a tower;

b) a winch with a wire positioned at an upper end of the tower so that an upper rim of a reel of the winch protrudes above the top of the tower;

c) a main boom which at a first end is pivotally connected to the tower and at a second end the main boom is pivotally connected with a first end of a knuckle boom, a second free end of the knuckle boom is provided with at least one sheave, where the main boom is provided with an aperture proximate to the first end of the main boom, where the wire is routed directly from the reel of the winch through the aperture of the main boom and directly to the at least one sheave at the second free end of the knuckle boom.

2. A knuckle two boom crane according to claim 1, further comprising an operator cabin fixed to the tower.

3. A knuckle two boom crane according to claim 1, further comprising a machine house.

4. A knuckle two boom crane according to claim 1, where the winch is electro hydraulic operated.

5. A knuckle two boom crane according to claim 1, where the winch is provided with at least one electric motor and at least one hydraulic motor.

6. A knuckle two boom crane according to claim 1, where the winch is rotatably arranged between two support plates which extend out from an upper side of the tower opposite of the main boom.

7. A knuckle two boom crane according to claim 1, where the main boom is boomerang shaped and where the concave side of the boom faces downward.

8. A knuckle two boom crane according to claim 1, where vertical movements of the main boom and the knuckle boom is provided by at least two cylinders, where the at least two cylinders are one of: hydraulic cylinder, electro hydraulic cylinder or electric cylinder.

* * * * *